US005949227A

United States Patent [19]

Bujanos

[11] Patent Number: 5,949,227

[45] Date of Patent: Sep. 7, 1999

[54] LOW POWER CIRCUIT FOR DISABLING STARTUP CIRCUITRY IN A VOLTAGE REFERENCE CIRCUIT

[75] Inventor: Norman Bujanos, Austin, Tex.

[73] Assignee: Advanced Micro Devices, Inc., Austin, Tex.

[21] Appl. No.: 08/995,268

[22] Filed: Dec. 22, 1997

[51] Int. Cl.[6] ..... G05F 3/16

[52] U.S. Cl. ..... 323/313; 323/901

[58] Field of Search ..... 323/313, 314, 323/901

[56] References Cited

U.S. PATENT DOCUMENTS

| | | | |
|---|---|---|---|
| 4,742,281 | 5/1988 | Nakano et al. | 323/313 |
| 4,857,823 | 8/1989 | Bitting | 323/314 |
| 5,367,249 | 11/1994 | Honnigford | 323/901 |
| 5,391,980 | 2/1995 | Thiel et al. | 323/314 |

OTHER PUBLICATIONS

A Simple Three–Terminal IC Bandgap Reference, IEEE Journal of Solid–State Circuits, vol. SC–9, No. 6, Dec. 1974, pp. 388 through 393.

Low–Noise, Low–Power, Low–Voltage; Mixed–Mode Design with CAD Tools; Voltage, Current and Time References, Analog Circuit Design, Dec. 1996, pp. 269, 280 through 282.

*Primary Examiner*—Jeffrey Sterrett

*Attorney, Agent, or Firm*—Akin, Gump, Strauss, Hauer & Feld, LLP

[57] ABSTRACT

A low power voltage reference circuit is provided, it has a normal operating mode and a low power mode. In the low power mode, a startup circuit is isolated and operates in low power, and the voltage reference portion of the circuit also operates in low power and provides low voltage output. When the circuit is instead enabled, the startup circuitry forced the referenced circuitry out of its low power mode and into a stable, reference mode.

17 Claims, 4 Drawing Sheets

LOW POWER CIRCUIT FOR DISABLING STARTUP CIRCUITRY IN A VOLTAGE REFERENCE CIRCUIT

BACKGROUND OF THE INVENTION

1. Field of the Invention

The present invention relates to power supply circuits, and more particularly to voltage references in electronic circuits.

2. Description of Related Art

Many electronic circuits rely on a constant, reliable voltage source for providing power to various elements within the circuit. Although many electronic circuits receive a $V_{CC}$ voltage power supply and a $V_{SS}$ ground reference voltage from an external power supply, voltage reference signals may not be entirely constant with respect to time. Spurious surges, noise and voltage fluctuations may arise due to any number of sources, including other devices in the circuit transitioning state or developing performance problems.

A bandgap voltage reference addresses the problem of fluctuating reference voltages. Bandgap voltage references provide a substantially constant and reliable output voltage controlled by transistors and resistors within a voltage reference circuit. Bandage voltage reference circuits provide an output signal having a voltage that depends primarily on the ratio of various resistive elements and on the numbers and the arrangement of transistors, with only a slight dependency on the stability of the external power supply.

Voltage reference circuits are typically configured as "delta $V_{BE}$" style generators. The output voltage of the voltage reference circuit is determined by a set of two equations having two independent simultaneous solutions. The first solution defines an active state in which the voltage reference circuit provides its reference voltage with a substantially constant power supply voltage. The second solution defines an inactive state in which the voltage reference circuit output ($V_{BG}$) is approximately equal to the $V_{SS}$ (i.e., the ground voltage).

Bandgap voltage reference circuits have typically provided an output signal whenever the external voltages (i.e., $V_{CC}$ and $V_{SS}$) are applied. Upon startup, however, such circuits may start in the inactive state.

To avoid initializing in the inactive state, many bandgap reference generators have included a startup circuit coupled to the bandgap voltage reference. The startup circuit receives an indication of whether an internal node within the bandgap voltage reference circuit has a voltage corresponding to the inactive state, and responds to the reference circuit being in that inactive state by driving the reference circuit to the active state.

Although voltage reference circuits are useful in many situations, it has not always proven advantageous for the voltage reference to be on. For example, many portable computers require a low power consumption mode, such as a sleep mode, while in other electronic circuitry several different power supply circuits may be included. In another words, it is at times advantageous for the voltage reference to be switched into the inactive state in which the output voltage, $V_{BG}$, is zero.

Thus, although the startup circuit is useful for driving the voltage reference circuit output to the active state during normal operation, the presence of a startup circuit may be disadvantageous when it is desired for the voltage reference circuits that provide a grounded output.

SUMMARY OF THE INVENTION

Briefly, a voltage reference according to the present invention allows an externally-generated signal to override the normal operation of the reference generator. The reference generator receives an enable signal as an input. When the enable signal is asserted, the bandgap reference circuit and the startup circuit operate normally. The output voltage of the reference circuit is driven to the desired, active state and corresponding voltage. However, when the enable signal is deasserted, the startup circuit is disabled, and the reference voltage is driven to the inactive state, in which the output voltage is substantially grounded (i.e., at the voltage of the $V_{SS}$ signal). Further, when the enable signal is deasserted, both the reference circuit and the startup circuit are placed in a low power mode in which current drain is minimal. This is achieved by effectively decoupling and isolating the two circuits.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
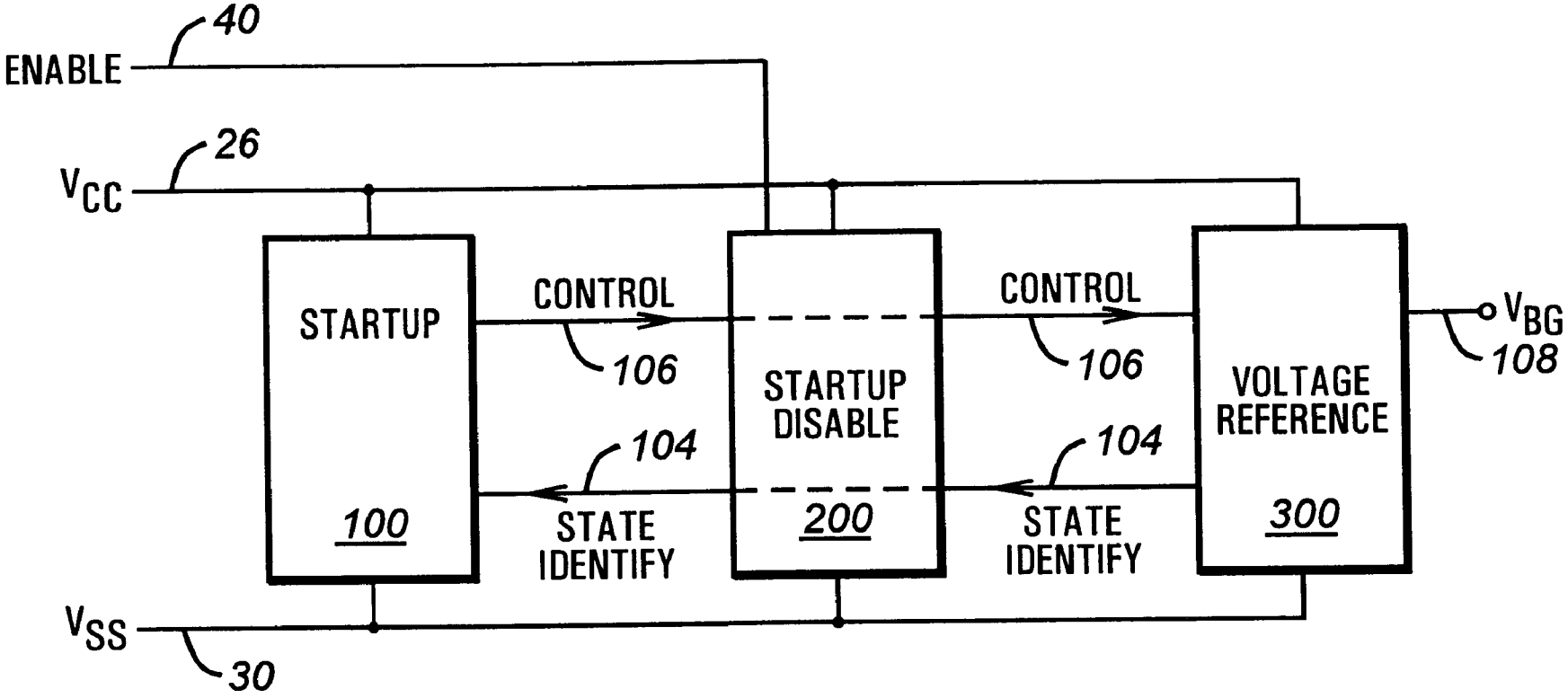
FIG. 1 is a block diagram overview of a voltage reference having a startup circuit, startup disable circuit, and voltage reference circuit.

Referring now to FIG. 1, an overview of a startup circuit 100, a startup disable circuit 200, and a voltage reference circuit 300 is shown. Each of the three circuits receives two supplies $V_{CC}$ 20 and $V_{SS}$ 30. The voltage reference circuit 300 is coupled via a state identify signal 104 to the startup disable circuit 200 and the startup circuit 100. The startup disable circuit 200 and the startup circuit 100 also provide a control signal 106 to the voltage reference circuit 300. The startup disable circuit 200 also receives an enable signal 40. The voltage reference circuit 300 also provides an output reference voltage $V_{BG}$ 108.

THE VOLTAGE REFERENCE CIRCUIT

Figure 2:
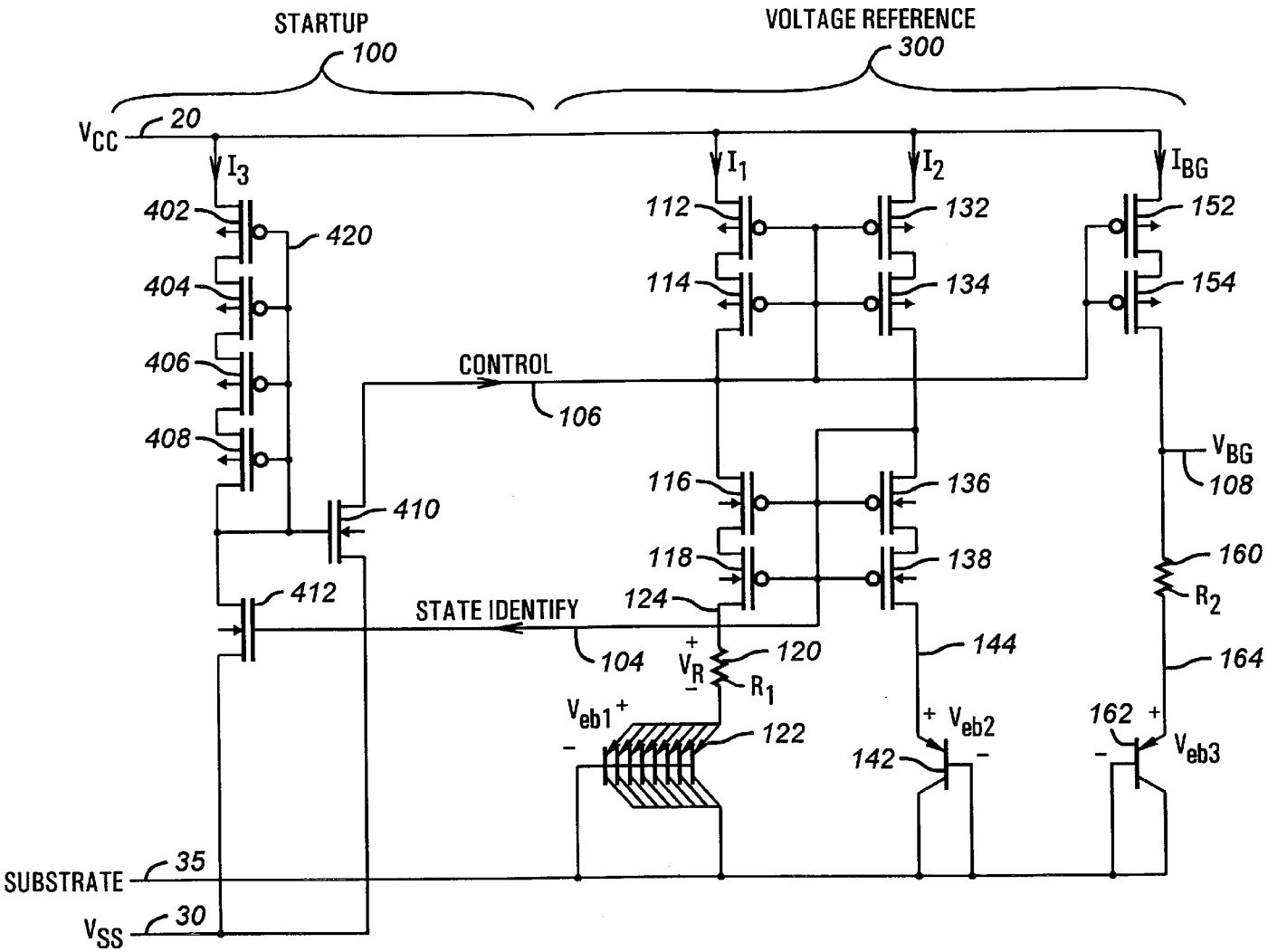
(PRIOR ART) FIG. 2
FIG. 2 is a schematic illustration of a voltage reference with a startup circuit, according to the prior art, shown in greater detail.

Referring now to FIG. 2, the voltage reference circuit 300 according to both the prior art and the present invention is shown in greater detail. (For clarity, the MOS transistor substrates' connections are omitted. The wells of the p-channel devices are tied to $V_{CC}$ 20, while the substrates of the n-channel devices are part of a device substrate designated SUBSTRATE 35. In the disclosed embodiment, SUBSTRATE 35 is connected to $V_{SS}$ 30, which are both at ground level.) The voltage reference circuit 300 provides a constant output voltage at the output signal $V_{BG}$ 108 during active operation.

As described in reference to FIG. 1, the voltage reference circuit 300 receives $V_{CC}$ 20 and $V_{SS}$ 30. Referring again to FIG. 2, the voltage reference circuit 300 provides multiple current paths from $V_{CC}$ 20 to $V_{SS}$ 30. The control signal 106 and the state identifier signal 104 provide intermediate nodes within the voltage reference circuit 300. Current mirrors are included to create equal current sources in three current paths. $I_1$, $I_2$, and $I_{BG}$. Each of these current paths and current mirrors is described so that the operation of the voltage reference circuit 300 may be understood.

The upper portion of the voltage reference 300 of FIG. 2 is now described. A first current path $I_1$ includes MOS transistors 112 and 114 in series between $V_{CC}$ 20 and the control signal 106. A second current path $I_2$ includes MOS transistors 132 and 134 provided in series between $V_{CC}$ 20 and the state identifier signal 104. Similarly, a third current path $I_{BG}$ includes MOS transistors 152 and 154, a resistor 160, and a bipolar transistor 162, all in series between $V_{CC}$ 20 and $V_{SS}$ 30.

These transistors 112, 114, 132, 134, 152, and 154 are gated by the same signal (i.e., the control signal 106) and therefore conduct or cut off in unison. Throughout this description, these transistors are collectively referred to as the "first group" of transistors. Moreover, the transistors 112, 132 and 152 are matched, and all three have source terminals tied to $V_{CC}$ 20. Thus, these three transistors 112, 132 and 152 form a current mirror, and the currents through the transistors 132 and 152 are identical to the current through the transistor 112. Throughout this description, therefore, the transistors 112, 132, and 152 are referred to as the "first current mirrors."

The lower portion of FIG. 2 is now described. The first current path $I_1$ of the voltage reference circuit 300 of FIG. 2 also includes, between the control signal 106 and $V_{SS}$ 30, MOS transistors 116 and 118 connected in series with a resistor 120 and eight parallel bipolar transistors. The eight parallel bipolar transistors of the first current path are collectively referred to as a bipolar transistor 122, and split the current of the first path into eight identical paths from the resistor 120 to the signal 30. The second current path 12 of the voltage reference circuit 300 of FIG. 2 provides, between the state indicator signal 104 and the $V_{SS}$ signal 30, two MOS transistors 136 and 138 and a bipolar transistor 162, all connected in series.

The state identify signal 104 is connected to the gate terminal of transistors 116, 136, 118 and 138, creating a current mirror such that the current through the second path $I_2$ is mirrored to the first path $I_1$. These transistors 116, 118, 136, and 138 are gated by the same signal (i.e., the state indicator signal 104) and therefore conduct or cut off in unison. Throughout this description these transistors are collectively referred to as the "second group" of transistors. The gate terminal of the transistors 116, 118, 136, and 138 are connected to the control signal 106. Throughout this description, the transistors 116, 118, 136, and 138 are referred to as the "second current mirrors."

As will be appreciated, the transistors 132 and 134 mirror the current $I_1$ through the transistors 112 and 114 because the gates of all are connected to the drain of the transistor 114. Similarly, the transistors 116 and 118 mirror the current 12 through the transistors 136 and 138 because the gates of all are connected to the drain of the transistor 136.

THE DELTA $V_{BE}$ GENERATOR

The lower portion of the voltage reference 300 of FIG. 2 contains a delta-$V_{BE}$ generator. As stated previously, the first current path $I_1$ of the voltage reference circuit 300 of FIG. 2 includes eight identical parallel bipolar transistors, collectively referred to as the bipolar transistor 122. Each of these carries an equal current, defined by the emitter-to-base voltage of the transistor 122.

The current in each of the eight transistors within the bipolar transistor 122 is:

$$I=I_S[\exp(qV_{eb1}/kT)-1], \tag{1}$$

where $I_S$ is the saturation current, q is Coulombic charge, $V_{eb1}$ is the emitter-to-base voltage of the pup transistor 122, k is Boltzmann's constant, and T is junction temperature in degrees K.

The transistor 122 carries eight times this current, but the two current paths have mirrored currents; that is $I_1=I_2$. With $V_{eb2}$ presenting the emitter-to-base voltage of the transistor 142, it follows:

$$I_2=I_S[\exp(qV_{eb2}/kT)-1] \tag{2}$$

$$I_1=8I_S[\exp(qV_{eb1}/kT)-1] \tag{3}$$

$$I_S[\exp(qV_{eb2}/kT)-1]=8I_S[\exp(qV_{eb1}/kT)-1] \tag{4}$$

simplifying and taking logs of both sides:

$$(V_{eb2}-V_{eb1})=1n(8)kT/q \tag{5}$$

But further, the voltage at node 124 must equal the voltage at node 144 because $I_1=I_2$ and the gates of the identical transistors 118 and 138 are connected. Thus:

$$V_{eb1}+V_R=V_{eb2} \tag{6}$$

$$V_R=I_1R \tag{7}$$

$$V_{eb2}-V_{eb1}=I_1R \tag{8}$$

Substituting equation (8) into equation (5):

$$I_1=(1n(8)/R_1)(kT/q) \tag{9}$$

This is the active operating point of the current mirrors for $I1=I2\neq 0$.

But referring to equations (2, 3, 4) above, it will be appreciated that an acceptable operating point is also $I_1=I_2=0$. This leads to the need for a startup circuit.

The third current path for current $I_{BG}$ includes, connected between $V_{CC}$ 20 and $V_{SS}$ 30, transistors 152 and 154, resistor 160, and bipolar transistor 162, all in series. The current $I_{BG}$ in the third current path crosses resistor 160 and bipolar transistor 162. Assumning trivial additive resistance of the bipolar transistors 122 and 162, because $I_{BG}=I_1$:

$$V_{BG}=I_1R_2+V_{eb3} \tag{10}$$

$$V_{BG}=(R_2/R_1)1n(8)(kT/q)+V_{eb3} \tag{11}$$

The term on the left rises with temperature; the term on the right tends to fall. Thus, the voltage $V_{BG}$ tends to remain constant regardless of temperature. Further, because VCC is not a term, output voltage $V_{BG}$ is independent of input voltage. Thus, controlling resistance ratios controls the output voltage in the active state.

INACTIVE AND ACTIVE OUTPUT STATES

Under normal operating conditions, the active state is desired and the inactive state is not desired. The operating condition or state of the voltage reference circuit 300, therefore, is normally desired to be in active state. The control signal 106 is an input to the voltage reference circuit 300 that can be used to force the voltage reference circuit 30 into the active state.

When the control signal 106 is at a low voltage, i.e. below the threshold voltage of the transistors in the first group, the voltage reference circuit 300 is driven active. The transistors of the first current mirror are forced to an on state, raising the voltage of state indicator signal 104 and allowing current to flow through the first, second, and third current paths. The output voltage $V_{BG}$ 108 is then defined by the equation (11) above.

However, the voltage on the control signal 106 can reside at a high voltage, i.e. above the threshold voltage of the transistors in the first group, while the voltage of the state identity signal 104 is at a low voltage. The transistors of the first current mirror are then in an off state, and substantially no current flows through the three current paths.

The state of the circuit can be determined by examining the state indicator signal 104. When the voltage of the state indicator signal 104 is low, i.e. approximately the voltage of the substrate 35, the control signal 106 carries a high voltage and the voltage reference circuit 300 is in the inactive state. No current flows through the third current path, and the output voltage $V_{BG}$ 108 is undriven.

On the other hand, if the voltage of state indicator signal 104 is high enough to turn the transistors 136 and 138 on, the control signal 106 carries a lower voltage and the voltage reference circuit 300 is in an active state. Thus, the voltage of the state indicator signal 104 may be used to determine whether current is present through the first current mirror.

While the control signal 106 is an input that can force the voltage reference circuit 300 into an active state, the control signal 106 cannot be permanently tied to a low voltage. Such a circuit would destroy the current mirroring properties of the two paths $I_1$ and $I_2$.

THE STARTUP CIRCUIT

Referring again to FIG. 2, the startup circuit 100 is also shown. The startup circuit 100 includes PMOS transistors 402, 404, 406 and 408, and a "kickstart" NMOS transistor 412, connected in series between $V_{CC}$ 20 and $V_{SS}$ 30. The startup circuit 100 also includes a transistor 410 between the control line 106 and $V_{SS}$ 30. All of the startup transistors 402–410 are gated by a startup node signal 420, which is coupled to the drain of a transistor 412.

Transistors 402–408 tend to place a self-restoring high voltage on the startup node signal 420. When the startup node signal 420 has a low voltage, the transistors 402–408 begin to conduct, tending to restore the voltage of the startup node signal 420 to a higher voltage. It may be said that the startup node signal 420 has a tendency to "float high," via "pullup" transistors 402–408. That is, virtually no current 13 need flow to maintain that high voltage. However, the "kickstart" transistor 420 provides a grounding path for the startup node signal 420. The transistor 412 has a much lower on resistance than the series of transistors 402–408. Therefore, the transistor 412 is selectably able to ground the startup node signal 420. When the transistor 412 is not grounding the startup node signal 420, the startup node signal 420 "floats" to its high voltage.

The startup circuit 100 controls the control signal 106. When the voltage of the startup node signal 420 exceeds the threshold voltage of the startup circuit transistors 402–410, and in particular the transistor 410, the transistor 410 turns on the control signal 106 is pulled low (i.e., to the voltage of the $V_{SS}$ signal 30) by the transistor 410.

Alternatively, when the voltage of the startup node signal 420 is pulled low, i.e. less than the threshold voltage of the startup circuit transistors 402–410 and in particular the transistor 410, then the control signal 106 is open-circuited by transistor 410, and the startup circuit 100 has no effect on the voltage reference circuit 300.

The startup circuit 100 is controlled by the state indicator signal 104. When the voltage of the state indicator signal 104 is low, indicating the voltage reference is in the inactive state with $I_1$=$I_2$=zero, the transistor 412 is off. Therefore, the voltage on the node 420 is high, so the transistor 410 turns on. This forces the controlling signal 106 low, forcing the voltage reference into the active state.

But this in turn causes the state identity signal 104 to rise, turning on the transistor 412, which pulls the voltage at node 420 low. This in turn turns off the transistor 410, allowing the voltage reference to operate in its active state.

In summary, the startup circuit 100 detects the state of the voltage reference circuit 300 via the transistor 412. If the voltage reference circuit 300 is in the active state, the startup node signal 420 is grounded via the transistor 412, and the startup circuit 100 is disconnected via transistor 410. Consequently, the startup circuit has no effect. On the other hand, if the voltage reference circuit 300 is in the inactive state, the transistor 412 allows node 420 to float to a high voltage, grounding the control signal 106 via the transistor 410, forcing the voltage reference circuit 300 to the active state. Thus, the startup circuit 100 ensures the device is always in an active state.

Figure 3:
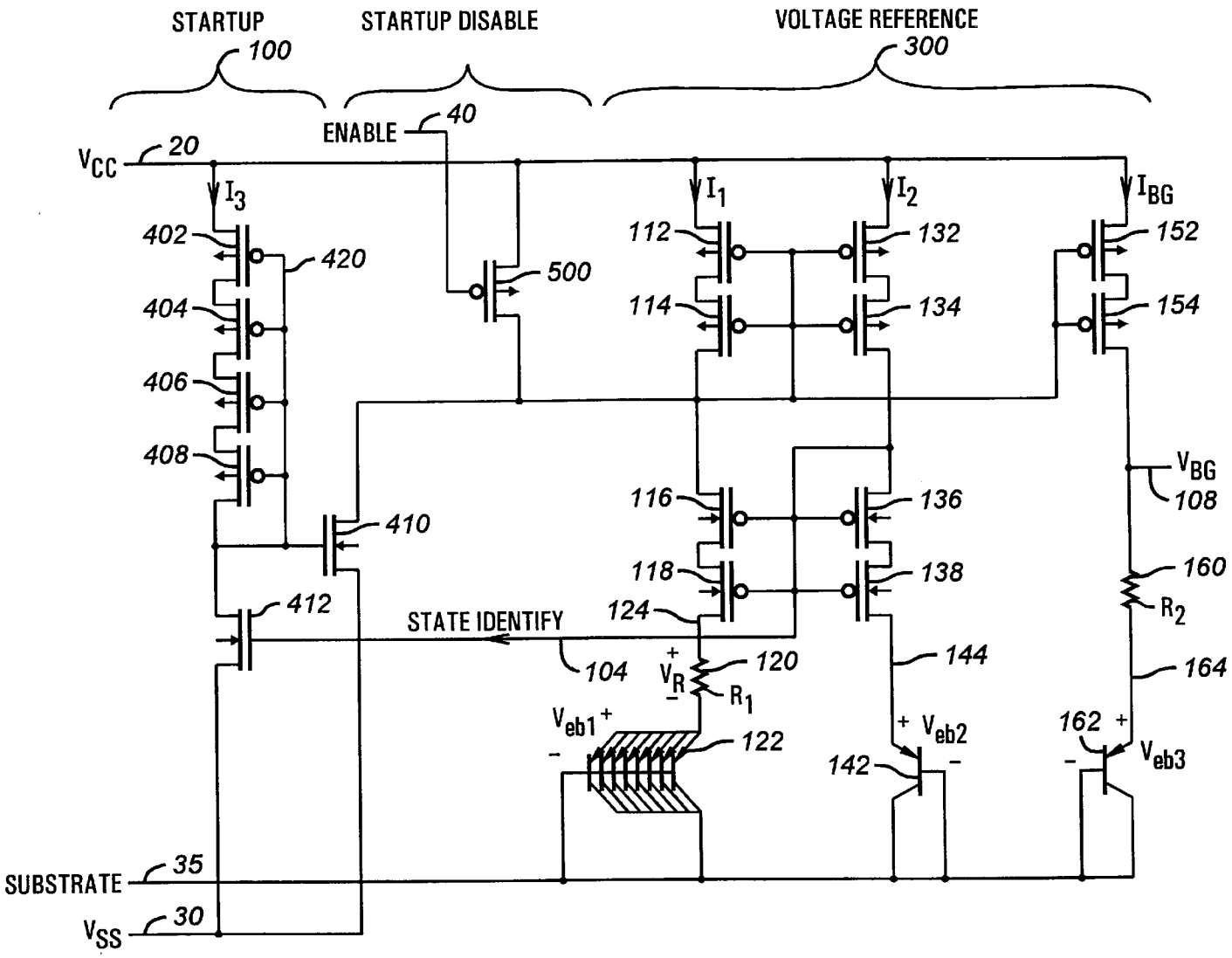
FIG. 3 is a schematic illustration of a voltage reference having an enable/disable transistor.

While operating the voltage reference circuit 300 in the active state is typically desired, there are situations in which the active state is not desired. Specifically, if the voltage circuit 300 is part of a device that operates in a low current/low power mode, it is desirable to shut off all current flow through the voltage reference circuit 300. In such an instance, it would be desirable for $I_1$,$I_2$, and $I_{BG}$ to all be as low as possible, preferably zero. Referring to FIG. 3, it is apparent that this can be achieved by arbitrarily driving the control signal 106 high, forcing the voltage reference circuit into the inactive state. This turns off the transistors 112, 114, 132, 134, 152, and 154 thereby forcing $I_1$, $I_2$, and $I_{BG}$ to zero. This can be achieved via a transistor 500, which is coupled to the enable signal 40. When the enable signal 40 is high, the transistor 500 is turned off. In this state, the circuit operates as does the circuit of FIG. 2. When the enable signal of 110 is driven low, however, the transistor 500 turns on, forcing the control signal 106 to $V_{CC}$ 20, in turn forcing the voltage reference 300 into an inactive state, reducing current flows $I_1$ and $I_2$ to negligible levels.

This configuration, however, presents its own problem. When the enable signal 40 is low, reducing the currents $I_1$, $I_2$, and $I_{BG}$ to virtually zero, the state identify signal 104 correspondingly drops to a low voltage, (the substrate 35 voltage), but not all the way to $V_{SS}$ 30. This unfortunately permits the transistor 412 to conduct slightly, allowing the current 13 to have some non-negligible value. Further, however, that current flow is not enough to drop the voltage of the node 420 sufficiently to turn off the transistor 410. Therefore, the transistor 410 is on, attempting to pull the control signal 106 low, while at the same time the transistor 500 is on, attempting to drive the control signal 106 high. Further, current flows through the transistor 500 and on through the transistors 116, 118, and 122. This causes a high current path from $V_{CC}$ 20 to $V_{SS}$ 30. So while the voltage reference 300 draws very little current, the startup circuit 100 through the enable transistor 500 draws a very high current.

START UP DISABLE

Figure 4:
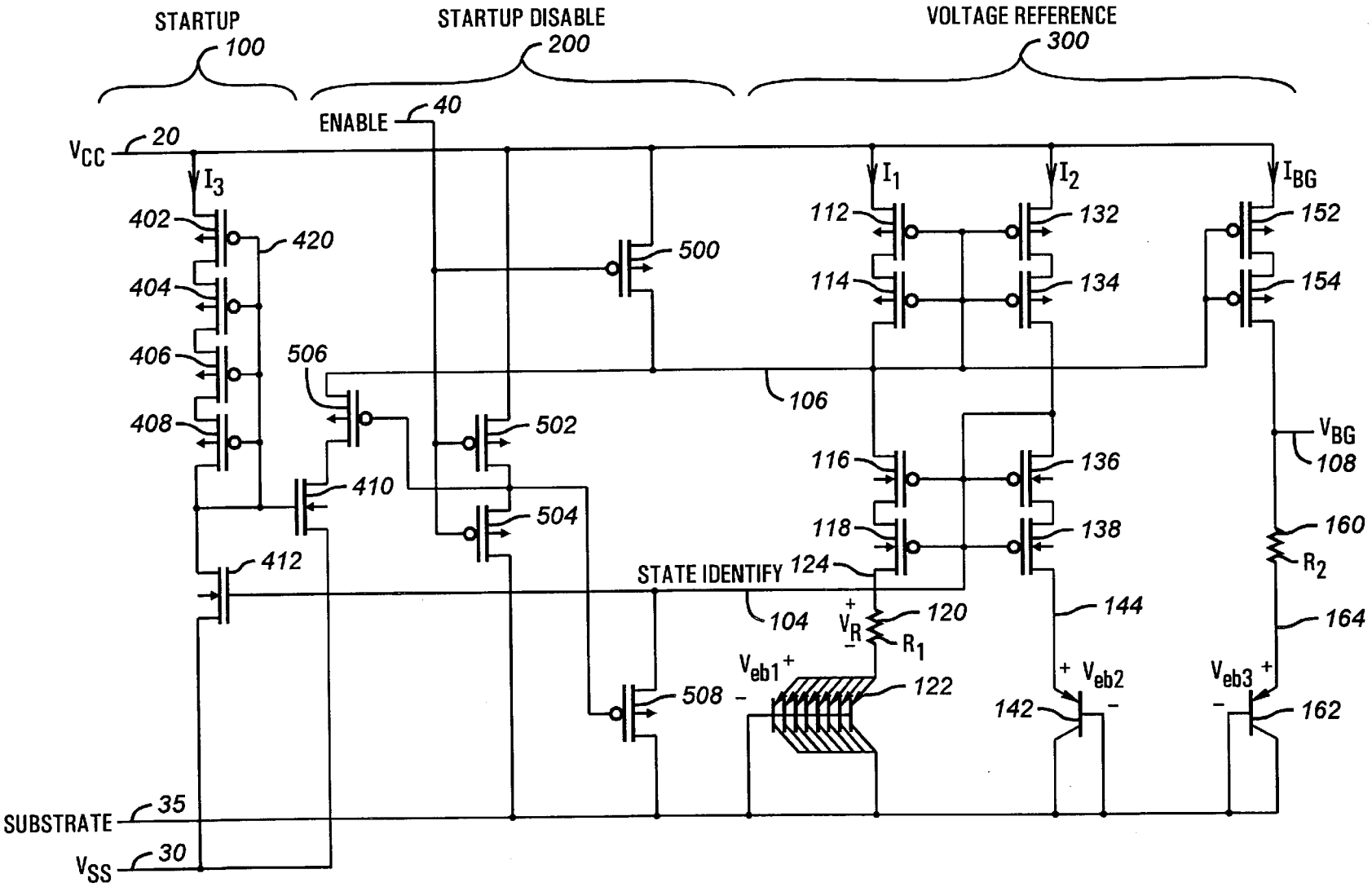
FIG. 4 is a schematic illustration of a voltage reference having a voltage reference circuit, a startup circuit, and a startup disable circuit according to the present invention.

Referring to FIG. 4, shown as a modification of the circuit of FIG. 3 which allows for a low power mode in a circuit with both the voltage reference circuit 300 and the startup circuit 100. As in FIG. 3, an enable signal when low drives the enable transistor 500 on, forcing the control signal 106 high, and placing the voltage reference circuit 300 into a low current mode. The enable signal, however, is further tied to the gates of a transistor 502 and a transistor 504. The source of the transistor 502 is coupled to $V_{CC}$ 20, and its drain is coupled to the drain of the transistor 504. The source of the transistor 504 is coupled to $V_{SS}$ 30. Both the drains of the transistors 502 and 504 in turn drive the gates of the two transistors 506 and 508. Before turning to the operation of those two transistors 506 and 508, it will be appreciated that when the enable signal 40 is high, the transistor 502 is off and the transistor 504 is on, driving their common drains to the low voltage $V_{SS}$ 30. Conversely, when the enable signal 40 is low, indicating low power operation, the common drains of the transistors 502 and 504 are pulled high to $V_{CC}$ 20.

The transistor 506 is coupled along the control signal 106 line between the voltage reference circuit 300 and the transistor 410. The transistor 506 is turned on when the enable signal 40 is true. The transistor 506 is turned off when the enable signal 40 is low, or false.

The transistor 506 is coupled between the state identify line 104 and $V_{SS}$ 30. The transistor 508 operates conversely to the transistor 506, turning off when the enable signal 40 is true and turning on when the enable signal 40 is false.

The startup disable circuit 200 of FIG. 4 operates to force the startup circuitry 100 into a low power mode when the enable signal 40 is false. When the enable signal 40 is true, the circuit of FIG. 4 operates identically to the circuit of FIG. 3. This is because the transistor 506 is on, coupling the control signal 106 between the startup circuit 100 and the voltage reference circuit 300, and the state identify signal 104 is not being pulled to $V_{SS}$ 30 by the transistor 508.

However, when the enable signal 40 is false, indicating a desire to operate in low power mode, the transistor 506 is turned off. This prevents the previously mentioned current drain through the transistor 500 and on through the transistor 410. The transistor 500 still conducts, forcing the voltage reference circuit 300 into a low current mode, but the transistor 410, whether on or off, can no longer form a current path to $V_{SS}$ 30.

The transistor 508, however, is turned on. This pulls the state identify signal 104 to $V_{SS}$ 30 (but does not form a current path to $V_{SS}$ 30), which turns off the transistor 412 and correspondingly turns on the transistor 410. But again, although the transistor 410 is on, it has been isolated by the transistor 506. Therefore, virtally no current flows through the current path $I_3$ because the transistor 412 is off, but simultaneously, no current path is formed through the transistor 500 and 410 because of the isolation transistor 506. In this way, when the enable signal 40 is false, both the startup circuit 100, the startup disable circuit 200 and voltage reference circuit 300 all operate in a low current mode.

The transistor 508 also serves to eliminate a potential second current path while in the low power mode. When the enable signal is deasserted, the transistor 508 turns on, pulling the state identify signal 104 low. This in turn forces the transistors 116 and 118 off. This prevents a potential current path from $V_{CC}$ 20 through the enable transistor 500 and then on through the transistors 116, 118, and 122.

Therefore, the voltage reference disclosed in FIG. 4 provides a startup circuit 100, a voltage reference circuit 300, and a startup disable circuit 200 that combine to allow a normal voltage reference operation when the enable signal is asserted, but provide a low power mode when the enable signal is deasserted. Specifically, when the enable signal is deasserted, the voltage reference 300 and the startup circuit 100 are effectively isolated from each other and potential current paths are disabled or blocked. This provides a low power mode of operation when the voltage reference is disabled.

It will be appreciated that a variety of other circuitry could replace particular elements of the circuit of FIG. 4. Specifically, the startup circuit 100 could be replaced by a variety of startup circuits, and the voltage reference circuit 300 could be implemented as a variety of other types of voltage references other than delta $V_{BE}$ references. Further, the startup disable circuit 200 could employ a number of configurations of circuitry while accomplishing the same result. By using the techniques according to the invention, however, a voltage reference circuit, and a startup circuit can operate in a low current consumption, low power mode through implementation of a startup disable circuit.

What is claimed is:

1. A voltage reference having a low power mode responsive to deassertion of an enable signal, comprising:

a voltage reference circuit providing an output reference voltage at a first, reference level when the voltage reference circuit is in a first, active state and at a second level when the voltage reference circuit is in a second, low power state, the voltage reference circuit receiving a control input that, when active, drives the voltage reference circuit into the first, active state;

a startup circuit that provides a control output at a level suitable for driving the voltage reference into the first, active state; and a startup disable circuit coupled between the startup circuit and the voltage reference circuit, the startup disable circuit coupling the control output of the startup circuit to the control input of the voltage reference circuit when the enable signal is asserted, and isolating the startup circuit from the voltage reference circuit when the enable signal is deasserted.

2. The voltage reference of claim 1, wherein the startup circuit provides the control output at the level suitable for driving the voltage reference into the first, active state responsive to the voltage reference circuit being in the second, low power state.

3. The voltage reference of claim 2, wherein the startup circuit receives a state identify signal from the voltage reference circuit indicative of when the voltage reference circuit is in the second, low power state.

4. The voltage reference of claim 3, wherein the startup disable circuit isolates the state identify signal from the startup circuit responsive to the enable signal being deasserted.

5. The voltage reference of claim 4, wherein the startup disable circuit comprises:

a first transistor to pull up the control input of the voltage reference circuit responsive to the enable signal being deasserted;

a second transistor to pull down the state identify signal responsive to the enable signal being deasserted; and a third transistor to decouple the control output of the startup circuit from the control input of the voltage reference circuit responsive to the enable signal being deasserted.

6. The voltage reference of claim 1, wherein the startup disable circuit isolates the startup circuit from the voltage reference circuit such that the startup circuit and the voltage reference circuit draw minimal current.

7. The voltage reference of claim 1, wherein the voltage reference circuit is a delta $V_{BE}$ style reference circuit.

8. The voltage reference of claim 7, wherein the voltage reference circuit includes two current mirrors.

9. The voltage reference of claim 8, wherein the voltage reference circuit includes a third, output circuit that provides the output reference voltage.

10. The voltage reference of claim 1, wherein the second level is approximately ground voltage.

11. The voltage reference of claim 1, wherein the startup circuit comprises:

a series of pull up transistors connected to a positive supply;

a pull down transistor connected between the series of pull up transistors and a negative supply; and a control transistor gated by a junction between the pull down transistor and the series of pull up resistors, the control transistor when on pulling the control output to a level suitable to drive the voltage reference circuit into the first, active state, wherein the pull down transistor turns the control transistor on when the voltage reference circuit is in the second, low power state and the startup disable circuit is receiving the enable signal asserted.

12. The voltage reference of claim 1, wherein the startup disable circuit drives the control input of the voltage reference circuit to a level suitable to force the voltage reference circuit to the second, low power state responsive to the enable signal being deasserted.

13. A voltage reference having a low power mode responsive to deassertion of an enable signal, comprising:

a voltage reference circuit that provides a reference voltage;

a startup circuit for forcing the voltage reference circuit into an active state; and a startup disable circuit coupled between the voltage reference circuit and the startup circuit that isolates the voltage reference circuit from the startup circuit responsive to the enable signal being deasserted.

14. A method of operating a voltage reference in a low power mode, the voltage reference including a voltage reference circuit that provide an output reference voltage and a startup circuit that provides a control signal to force the voltage reference circuit into an active mode, the method comprising:

driving the control signal to a level suitable to drive the voltage reference circuit into an active mode in response to the voltage reference circuit being in an inactive mode;

receiving an enable signal at a deasserted value;

decoupling startup circuits control signal from the voltage reference circuit responsive to the enable signal being deasserted.

15. The method of claim 14, further comprising the steps of:

forcing the voltage reference circuit into the inactive mode responsive to the enable signal being deasserted.

16. The method of claim 14, further comprising the steps of:

isolating a state identify signal from the voltage reference circuit to the startup circuit in response to the enable signal being deasserted.

17. The method of claim 16, wherein the step of isolating further comprises the step of:

pulling the state identify signal to a ground level responsive to the enable signal being deasserted.

* * * * *